US009617615B2

(12) United States Patent
Senda et al.

(10) Patent No.: US 9,617,615 B2
(45) Date of Patent: Apr. 11, 2017

(54) GRAIN-ORIENTED ELECTRICAL STEEL SHEET AND METHOD FOR MANUFACTURING SAME

(71) Applicant: JFE STEEL CORPORATION, Tokyo (JP)

(72) Inventors: Kunihiro Senda, Tokyo (JP); Shigehiro Takajo, Tokyo (JP); Tomoyuki Okubo, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 0 days.

(21) Appl. No.: 15/022,710

(22) PCT Filed: Aug. 26, 2014

(86) PCT No.: PCT/JP2014/004382

§ 371 (c)(1),
(2) Date: Mar. 17, 2016

(87) PCT Pub. No.: WO2015/040799

PCT Pub. Date: Mar. 26, 2015

(65) Prior Publication Data

US 2016/0230240 A1 Aug. 11, 2016

(30) Foreign Application Priority Data

Sep. 19, 2013 (JP) ..... 2013-194173

(51) Int. Cl.
*C21D 8/12* (2006.01)
*C21D 9/46* (2006.01)
(Continued)

(52) U.S. Cl.
CPC ..... *C21D 8/1244* (2013.01); *C21D 8/12* (2013.01); *C21D 8/125* (2013.01); *C21D 8/1233* (2013.01);
(Continued)

(58) Field of Classification Search
None
See application file for complete search history.

(56) References Cited

U.S. PATENT DOCUMENTS 4,293,350 A 10/1981 Ichiyama
5,840,131 A 11/1998 Yakashiro
(Continued)

FOREIGN PATENT DOCUMENTS

CN 1171823 1/1998
CN 1643175 7/2005
(Continued)

OTHER PUBLICATIONS

Machine translation of JP2002060957A, Feb. 2002.*
(Continued)

*Primary Examiner* — Jie Yang
*Assistant Examiner* — Xiaowei Su
(74) *Attorney, Agent, or Firm* — RatnerPrestia

(57) ABSTRACT

Provided is a grain-oriented electrical steel sheet including: a forsterite base film formed on a surface of the steel sheet; and an insulating tension coating formed on the base film, in which when Ti intensity FX(Ti), Al intensity FX(Al), and Fe intensity FX(Fe) obtained through quantitative analysis by performing fluorescent X-ray analysis on the surface of the steel sheet satisfy FX(Ti)/FX(Al)≥0.15 and FX(Ti)/FX(Fe)≥0.004, the frequency of crystal boundaries of secondary recrystallized grains in the direction orthogonal to the rolling direction is 20 grain boundaries/100 mm or less, the mean thickness of the forsterite base film t(Fo) and the thickness of the insulating tension coating t(C) satisfies t(Fo)/t(C)≥0.3, and magnetic domain refining treatment is performed by irradiation with a laser beam, plasma flame, or electron beam, a sufficient iron loss reducing effect is achieved in a range where coating detachment does not occur.

16 Claims, 5 Drawing Sheets

(51) Int. Cl.

| | |
|---|---|
| ***C22C 38/00*** | (2006.01) |
| ***C22C 38/60*** | (2006.01) |
| ***H01F 1/16*** | (2006.01) |
| ***C22C 38/02*** | (2006.01) |
| ***C22C 38/04*** | (2006.01) |
| ***C22C 38/06*** | (2006.01) |

(52) U.S. Cl.

CPC ..... *C21D 8/1261* (2013.01); *C21D 8/1266* (2013.01); *C21D 8/1272* (2013.01); *C21D 8/1277* (2013.01); *C21D 8/1283* (2013.01); *C21D 8/1288* (2013.01); *C21D 9/46* (2013.01); *C22C 38/00* (2013.01); *C22C 38/001* (2013.01); *C22C 38/002* (2013.01); *C22C 38/02* (2013.01); *C22C 38/04* (2013.01); *C22C 38/06* (2013.01); *C22C 38/60* (2013.01); *H01F 1/16* (2013.01)

(56) References Cited

U.S. PATENT DOCUMENTS

| | | | | |
|---|---|---|---|---|
| 7,887,646 | B2 | 2/2011 | Nanba | |
| 2005/0126659 | A1 | 6/2005 | Homma | |
| 2009/0047537 | A1 | 2/2009 | Nanba | |
| 2010/0055481 | A1 | 3/2010 | Kubo | |
| 2013/0112319 | A1 | 5/2013 | Omura | |
| 2013/0129985 | A1 | 5/2013 | Inoue | |
| 2013/0143003 | A1* | 6/2013 | Takenaka | C21D 1/38 428/174 |

FOREIGN PATENT DOCUMENTS

| | | | | |
|---|---|---|---|---|
| CN | 101180411 | | 5/2008 | |
| CN | 103114181 | | 5/2013 | |
| EP | 0709470 | | 5/1996 | |
| EP | 1108794 | | 6/2001 | |
| EP | 1227163 | | 7/2002 | |
| EP | 1273673 | | 1/2003 | |
| EP | 2602343 | | 6/2013 | |
| JP | 572252 | | 1/1982 | |
| JP | 61124584 | A * | 6/1986 | |
| JP | 10204533 | | 8/1998 | |
| JP | 11279645 | | 10/1999 | |
| JP | 2984195 | | 11/1999 | |
| JP | 2002060957 | A * | 2/2002 | |
| JP | 2002194445 | | 7/2002 | |
| JP | 3456352 | | 10/2003 | |
| JP | 2006117964 | | 5/2006 | |
| JP | 201231512 | | 2/2012 | |
| JP | 201231518 | | 2/2012 | |
| JP | 201236447 | | 2/2012 | |
| JP | WO 2012017671 | A1 * | 2/2012 | C21D 1/38 |
| JP | 201292409 | | 5/2012 | |
| JP | 2012214902 | | 11/2012 | |
| RU | 2298592 | | 5/2007 | |
| RU | 2405842 | | 12/2010 | |

OTHER PUBLICATIONS

English Abstract of JP61-124584A, Jun. 1986.*

International Search Report for International Application No. PCT/JP2014/004382 mailed Dec. 9, 2014.

Written Opinion of the International Search Authority for International Application No. PCT/JP2014/004382 mailed Dec. 9, 2014.

Chinese Office Action dated Oct. 26, 2016 for Chinese Application No. 201480051407.5, including Concise Statement of Search Report, 6 pages.

Extended European Search Report for European Application No. 14846204.7, dated Nov. 11, 2016, 10 pages.

Russian Office Action with English search report for Russian Application No. 2016115007/02(023599), dated Dec. 28, 2016, 12 pages.

* cited by examiner

GRAIN-ORIENTED ELECTRICAL STEEL SHEET AND METHOD FOR MANUFACTURING SAME

CROSS REFERENCE TO RELATED APPLICATIONS

This is the U.S. National Phase application of PCT/JP2014/004382 , filed Aug. 26, 2014 , which claims priority to Japanese Patent Application No. 2013-194173 , filed Sep. 19, 2013, the disclosures of each of these applications being incorporated herein by reference in their entireties for all purposes.

TECHNICAL FIELD

This disclosure relates to a grain-oriented electrical steel sheet for use in an iron core material of a transformer or the like and a method for manufacturing the same.

BACKGROUND

Grain-oriented electrical steel sheets are material mainly used as the iron core of a transformer, and from the perspective of achieving high efficiency of a transformer, grain-oriented electrical steel sheets are required to have, among other material properties, low iron loss properties.

Therefore, normally, a base film mainly composed of forsterite is formed on the surface of the steel substrate of the steel sheet during final annealing, and during or after flattening annealing, coating (insulating tension coating) mainly composed of phosphate and colloidal silica is applied and baked thereon for the purpose of achieving insulation and applying tension to the steel sheet as a product. The tension applied to the steel sheet by such base film and insulating tension coating improves iron loss properties.

Further, in order to reduce iron loss, it is important to highly accord secondary recrystallized grains of the steel sheet with the (110)[001] orientation, i.e. the so called "Goss orientation". However, it is known that if the secondary recrystallized grains are caused to accord with this orientation too much, the iron loss ends up increasing.

Therefore, to address this issue, a technique has been developed to apply strains and grooves to the surface of a steel sheet to subdivide the width of a magnetic domain to thereby reduce iron loss, which is a magnetic domain refining technique. Among other magnetic domain refining techniques, non-heat resistant magnetic domain refining treatment is known to produce linear strain regions in a steel sheet to narrow magnetic domain widths and, although the effect is canceled by strain relief annealing, this treatment tends to have a more significant iron loss reducing effect compared to heat resistant magnetic domain refining treatment. Therefore this treatment is suitable for manufacturing low iron loss grain-oriented electrical steel sheets.

As methods for performing non-heat resistant magnetic domain refining treatment, methods using a laser beam, plasma flame, electron beam or the like are industrially used because of their high productivity.

As a method of such non-heat resistant magnetic domain refining treatment, for example, PTL1 (JPS57-2252B) proposes a technique of irradiating a steel sheet with a laser beam after final annealing to apply high-dislocation density regions to a surface layer of the steel sheet, to thereby narrow magnetic domain widths and reduce iron loss of the steel sheet. Further, magnetic domain refinement techniques using laser irradiation have been improved since PTL1, and grain oriented electrical steel sheets having better iron loss properties are being produced (see for example, PTL2 (JP2006-117964A), PTL3 (JPH10-204533A), and PTL4 (JPH11-279645A)).

As a technique of reducing iron loss by improving forsterite films, a technique of fixing Ti as TiN in the forsterite film is disclosed in PTL5 (JP2984195B).

Similarly, as a technique of reducing iron loss, a technique of specifying the contents of Ti, B, and Al in the forsterite film is disclosed in PTL6 (JP3456352B).

Further, PTL7 (JP2012-31512A) discloses a technique of controlling the N content in the base film to 3% or less and appropriately controlling the Al content and Ti content in the base film so that the iron loss after laser irradiation can be effectively reduced.

Further, PTL8 (JP2012-31518A) discloses a technique of preventing detachment of the forsterite film which tends to occur when performing non-heat resistant magnetic domain refining treatment.

CITATION LIST

Patent Literature

PTL 1: JPS57-2252B
PTL 2: JP2006-117964A
PTL 3: JPH10-204533A
PTL 4: JPH11-279645A
PTL 5: JP2984195B
PTL 6: JP3456352B
PTL 7: JP2012-31512A
PTL 8: JP2012-31518A

SUMMARY

Technical Problem

Non-heat resistant magnetic domain refining treatment using a laser beam, plasma flame, electron beam or the like comprises heating the steel sheet instantly and locally using energy fluxes of a laser beam, plasma flame, electron beam or the like, generating thermal strains, and linearly forming closure domains to thereby perform magnetic domain refinement. However, with this method, it is necessary to sufficiently increase the amount of local energy irradiation to obtain a sufficient iron loss reduction effect, and therefore detachment of the insulating tension coating easily occurs. If detachment of the insulating tension coating occurs, rust will be formed in a stage after manufacturing the steel sheet product and before forming the steel sheet into an iron core of a transformer, and further, the interlaminar resistance will be reduced.

From such perspective, for grain-oriented electrical steel sheets subjected to non-heat resistant domain refining treatment, irradiation is performed in a range in which detachment of the insulating coating does not occur, or if coating detachment occurs, the steel sheet is subjected to top coating in a temperature range in which thermal strains do not disappear. However, with the former, a sufficient iron loss reducing effect cannot be obtained, whereas with the latter, disadvantages are caused in terms of manufacturing costs and stacking factors.

The technique of PTL8 has been proposed to address this issue. However, if the iron loss reducing effect is prioritized, the coating detachment rate may reach as high as 70%, and coating detachment cannot be sufficiently prevented. Alternatively, coating detachment could be sufficiently prevented, but at the penalty of insufficient iron loss reducing effect.

Although the technique of PTL7 specifies the conditions of the base film for maximizing the effect of magnetic domain refining using laser irradiation, the detachment of insulating tension coating has not been taken into consideration.

Solution to Problem

It is considered that coating detachment resulting from non-heat resistant magnetic domain refining treatment occurs because the detachment region expands to or larger than a certain size in an area either between the steel substrate and the base film or between the base film and the insulating tension coating, dissipates the cross-linking effect of the coating itself and leads to detachment of the coating.

As a result of intensive studies made to solve the above problems, we discovered the following.

While increasing the strength of the base film itself, likely origins for the occurrence of detachment of the base film from the steel substrate are reduced. Further, conditions are arranged such that the base film sufficiently serves as a binder between the steel substrate and the insulating coating. By doing so, it is possible to effectively prevent detachment of the insulating tension coating, which would otherwise occur when using laser beam irradiation, plasma flame irradiation, electron beam irradiation or the like for magnetic domain refining, and as a result, a sufficient iron loss reducing effect can be obtained within a range causing no coating detachment.

This disclosure is based on these findings.

We thus provide:

1. A grain-oriented electrical steel sheet before or after subjection to non-heat resistant magnetic domain refining treatment, the grain-oriented electrical steel sheet comprising:

a forsterite base film formed on a surface of the steel sheet; and an insulating tension coating formed on the base film, wherein when contents (mass %) of Ti, Al, and Fe in the forsterite base film, obtained through quantitative analysis by applying correction with the ZAF method to results of fluorescent X-ray analysis on the surface of the steel sheet after removing the insulating tension coating are each specified as FX(Ti), FX(Al), and FX(Fe), the following formulas (1) and (2) are satisfied, $$FX(Ti)/FX(Al) \geq 0.15 \quad (1)$$

$$FX(Ti)/FX(Fe) \geq 0.004 \quad (2),$$

the frequency of crystal boundaries of secondary recrystallized grains in the direction orthogonal to the rolling direction is 20 grain boundaries/100 mm or less, and when the mean thickness of the forsterite base film is specified as t(Fo), and the thickness of the insulating tension coating is specified as t(C), the following formula (3) is satisfied:

$$t(Fo)/t(C) \geq 0.3 \quad (3).$$

2. The grain-oriented electrical steel sheet according to aspect 1, wherein the surface roughness of the forsterite base film in arithmetic mean roughness Ra is 0.2 μm or more.

3. The grain-oriented electrical steel sheet according to aspect 1 or 2, wherein when a tension applied by the forsterite base film to a steel substrate per surface is specified as TE(Fo) and a tension applied by the insulating tension coating to the steel substrate per surface is specified as TE(C), the following formula (4) is satisfied:

$$TE(Fo)/TE(C) \geq 0.1 \quad (4).$$

4. The grain-oriented electrical steel sheet according to any one of aspects 1 to 3, wherein the non-heat resistant magnetic domain refining treatment is performed by electron beam irradiation.

5. A method of manufacturing a grain-oriented electrical steel sheet comprising:

subjecting a steel slab to hot rolling to obtain a hot rolled sheet, the steel slab containing by mass %, S and/or Se: 0.005% to 0.040%, sol.Al: 0.005% to 0.06%, and N: 0.002% to 0.020%;

then subjecting the hot rolled sheet to hot band annealing or no hot band annealing;

subjecting the hot rolled sheet to subsequent cold rolling once, or twice or more with intermediate annealing performed therebetween to obtain a cold rolled sheet with final sheet thickness;

then subjecting the cold rolled sheet to primary recrystallization annealing;

then applying an annealing separator to the cold rolled sheet, the annealing separator containing 5 parts by mass or more of $TiO_2$ with respect to 100 parts by mass of MgO being the main component, so that coating amount M1 per steel sheet surface after application and drying is in a range of 4 g/m$^2$ to 12 g/m$^2$;

then subjecting the cold rolled sheet to final annealing;

subjecting the cold rolled sheet to subsequent continuous annealing in which flattening annealing, and application and baking of an insulating tension coating are performed; and then subjecting the cold rolled sheet to non-heat resistant magnetic domain refining treatment or no non-heat resistant magnetic domain refining treatment, wherein in a heating process of the final annealing, a heating rate V(400-650) between 400° C. and 650° C. is 8° C./h or higher, and a ratio V(400-650)/V(700-850) of the heating rate V(400-650) to a heating rate V(700-850) between 700° C. and 850° C. is 3.0 or more, and in the flattening annealing, coating amount M2 (g/m$^2$) of an insulating tension coating mainly composed of colloidal silica and phosphate per steel sheet surface after application and baking satisfies the following formula (5):

$$M2 \leq M1 \times 1.2 \quad (5).$$

6. The method of manufacturing a grain-oriented electrical steel sheet according to aspect 5, wherein the annealing separator contains 0.005 parts by mass to 0.1 parts by mass of Cl with respect to 100 parts by mass of MgO.

7. The method of manufacturing a grain-oriented electrical steel sheet according to aspect 5 or 6, wherein a maximum temperature $T_{FN}$ (° C.) in the flattening annealing is 780° C. to 850° C., mean tension S between ($T_{FN}$—10° C.) and $T_{FN}$ is 5 MPa to 11 MPa, and $T_{FN}$ and the mean tension S satisfy the following formula (6):

$$6500 \leq T_{FN} \times S \leq 9000 \quad (6).$$

8. The method of manufacturing a grain-oriented electrical steel sheet according to any one of aspects 5 to 7, wherein the non-heat resistant magnetic domain refining treatment is performed by electron beam irradiation.

Advantageous Effect

With this disclosure, it is possible to obtain grain-oriented electrical steel sheets for magnetic domain refining treatment in which coating detachment hardly occurs even if non-heat resistant magnetic domain refining treatment is performed due to the excellent coating adhesion property, or grain-oriented electrical steel sheets which have been subjected to non-heat resistant magnetic domain refining treatment. Further, if non-heat resistant magnetic domain refining treatment is performed using a laser beam, electron beam, plasma jet or the like within an extent causing not coating detachment, sufficiently low iron loss can be obtained.

DETAILED DESCRIPTION

Figure 1:
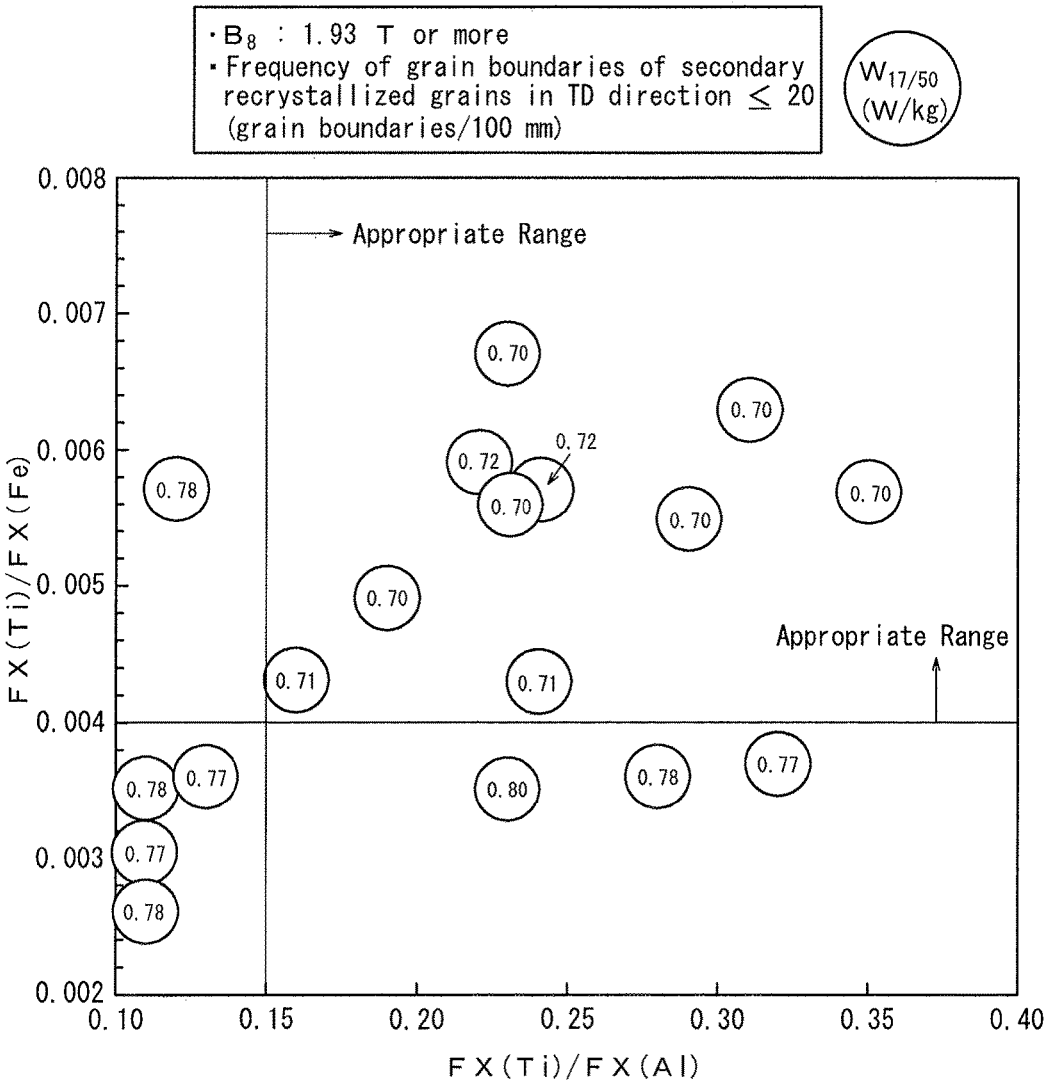
FIG. 1 shows the influence of FX(Ti)/FX(Al) and FX(Ti)/FX(Fe) on iron loss $W_{17/50}$.

Our methods and products will be described in detail below.

In the disclosure, expansion of the detached region to or larger than a certain size in an area either between the steel substrate and the base film or between the base film and the insulating tension coating is prevented, and at the same time, the frequency of likely origins of coating detachment is reduced, to prevent coating detachment resulting from non-heat resistant magnetic domain refining treatment. Further, by arranging conditions in which the base film sufficiently serves as a binder between the steel substrate and the coating, coating detachment which occurs when irradiating with a laser beam, electron beam, plasma jet or the like is prevented, and a sufficient magnetic domain refining effect can be achieved.

First, in order to prevent coating detachment from occurring between the steel substrate and the base film, it is necessary to prevent the coating itself from being damaged by thermal stress. By improving the bonding force between forsterite grains which are the main components of the base film to enhance the cross-linking effect, the risk of leading to coating detachment can be reduced even if the bonding between the steel substrate and the base film is reduced.

To improve the bonding force between such forsterite grains, it is considered effective to increase the Ti content in the base film, especially in the coating surface, and to reduce the content of Al and Fe.

It is considered that a crystal grain boundary of secondary recrystallized grains tends to become the origin for the occurrence of coating detachment, and that by reducing the frequency of grain boundaries of secondary recrystallized grains, it becomes possible to reduce the risk of coating detachment. This is because crystal grain boundaries of secondary recrystallized grains in the steel substrate surface after being subjected to thermal etching in a high temperature range during final annealing are formed into a recessed shape, and therefore energy such as a laser beam, electron beam, plasma jet or the like tends to concentrate in said boundaries. Further, since crystal grains across a crystal boundary have different crystal orientations, such crystal grains deform in different ways upon receipt of thermal stress even if the difference in mechanical characteristics is small, and therefore the base film is easily damaged.

In order to reduce these influences, it is preferable to reduce the frequency of crystal grain boundaries crossing the irradiation direction of a laser beam, plasma jet, electron beam or the like.

Further, by satisfying a sufficiently high ratio of the thickness of the base film to that of the insulating tension coating, the base film exhibits a sufficient effect as a binder, and the effect of preventing detachment of the insulating tension coating is increased. The reason is as follows. While the thermal expansion coefficient of an insulating tension coating mainly composed of phosphate and colloidal silica is very low compared to that of iron, the thermal expansion coefficient of a base film composed of forsterite is in between that of iron and the insulating tension coating. Therefore, when the temperature of the steel sheet surface is locally raised, the forsterite film serves as a binder by sufficiently absorbing the force to expand the insulating tension coating.

To this end, it is preferable to set the ratio of the thickness of the base film to the thickness of the insulating tension coating to be sufficiently high.

As mentioned above, the significantly advantageous effect described herein can be fully obtained by combining the following measures with different mechanisms:

(1) preventing damage to the base film itself, (2) reducing the number of origins of damage to the base film, and (3) providing an intermediate layer having a sufficiently high stress mitigation effect against the stress caused by thermal expansion of the insulating tension coating.

Further, in addition to the above measures, by increasing the surface roughness of the base film to a certain level, it is possible to prevent detachment of the base film from the insulating tension coating during irradiation with a laser beam, plasma jet, or electron beam, and an even better effect can be obtained.

Further, by controlling the tension TE(Fo) that is applied by the base film to the steel substrate (per surface) as well as the tension TE(C) that is applied by the insulating tension coating to the steel substrate (per surface), the strength of the base film can be further increased relative to the thermal expansion of insulating tension coating. This enables preventing detachment of forsterite grains during irradiation with a laser beam, plasma jet, or electron beam, and more effectively preventing said detachment from damaging the insulating tension coating.

Requirements regarding the grain-oriented electrical steel sheets described herein, the reasons for the limitations thereof and preferable ranges will be described hereinafter.

The surface of the steel sheet is subjected to fluorescent X-ray analysis, and the Ti content FX(Ti), the Al content FX(Al) and the Fe content FX(Fe) in the base film converted into content per mass (mass %) which are obtained by applying correction with the ZAF method satisfy the following formulas (1) and (2).

$$FX(Ti)/FX(Al) \geq 0.15 \quad (1)$$

$$FX(Ti)/FX(Fe) \geq 0.004 \quad (2)$$

In order to prevent coating detachment from occurring between the steel substrate and the base film, it is necessary to prevent damage to the coating itself resulting from thermal stress. To achieve this, the bonding strength between forsterite grains, which are the main components of the base film, is improved to increase the cross-linking effect and reduce the risk of leading to coating detachment even when the bonding between the steel substrate and the base film is reduced. In the base film, Ti is contained in forms such as TiN, $MgO.TiO_2$, or as Ti dissolved in crystal boundaries, and the existence of these components enhances the bonding strength between forsterite grains, increases the crosslinking effect in the forsterite film and prevents coating detachment.

Meanwhile, Al is contained in the forsterite film in the form of $Al_2O_3$ or $MgO.Al_2O_3$, and it is considered that the bonding strength between forsterite grains is reduced because these components are contained. Further, Fe is contained in the forsterite film as Fe particles, and the existence of such foreign matter reduces the mechanical strength of the forsterite itself, and the base film is damaged more easily during magnetic domain refining treatment.

As described above, while the strength of the base film itself against the damage resulting from thermal strains is increased as the Ti content in the base film increases, said strength decreases depending on the content of Al and Fe. Therefore, it is considered that the effect regarding strength improvement of the base film can be indexed using the ratios of these components. Further, since the coating surface tends to become the origins of cracks resulting from thermal strains, detachment hardly occurs if the coating surface is strengthened. Since fluorescent X-ray analysis is an analysis method with excellent detection sensitivity in the coating surface, said analysis method is considered to have a high correlation with coating detachment.

In view of the above, studies were made on preferable ratios of Ti, Al and Fe affecting the strength of the base film using measurements obtained from fluorescent X-ray analysis, and it was discovered that by satisfying the above relations (1) and (2), a desirable effect can be obtained.

By applying correction with the ZAF method to the count values obtained with a fluorescent X-ray, it is possible to sufficiently reduce the differences in measurements resulting from measurement devices and measurement conditions. As used herein, "Z" refers to the correction of fluorescent X-ray yield by an atomic number, "A" refers to the correction of X-ray absorption of the observed wavelength by a coexistent element, and "F" refers to secondary excitation correction by a fluorescent X-ray of a coexistent element (reference: "XRF Analysis of Ceramics and Allied Materials-Fundamentals and Applications-" (The Ceramic Society of Japan)).

In fluorescent X-ray analysis of the surface of the base film, the existence of insulating tension coating causes a variation in detection intensity per element depending on the thickness of said coating, and therefore it is necessary to remove said coating. To remove the insulating tension coating, it is suitable to immerse the steel sheet in a heated sodium hydroxide aqueous solution for a predetermined time and then to brush and wash the steel sheet.

By satisfying the conditions of formulas (1) and (2) when performing fluorescent X-ray analysis of the steel sheet surface, the strength of the forsterite base film is increased, and detachment of the insulating tension coating caused by damage to the base film itself during magnetic domain refining treatment is prevented.

FIG. 1 shows the results of studying the relation between FX(Ti)/FX(Al) and FX(Ti)/FX(Fe) and iron loss $W_{17/50}$ regarding a grain-oriented electrical steel sheet with a magnetic flux density $B_8$ of 1.93 T or more and frequency of grain boundaries of secondary recrystallized grains in the TD direction of 20 grain boundaries/100 mm or less, when performing magnetic domain refining treatment by plasma flame irradiation under the conditions of coating detachment rate: 3% to 5%.

As shown in FIG. 1, low iron loss is achieved when the relations of formulas (1) and (2) are satisfied.

Frequency of Grain Boundaries of Secondary Recrystallized Grains in Direction Orthogonal to Rolling Direction: 20 Grain Boundaries/100 mm or Less Since crystal grain boundaries of secondary recrystallized grains easily become starting points of coating detachment, it is possible to suppress detachment of the insulating tension coating by reducing the frequency of grain boundaries. Here, coating detachment is dependent on the frequency of crossing between the crystal grain boundaries and the parts irradiated with a laser beam, plasma flame, or electron beam. Such magnetic domain refining treatment is performed in a direction substantially perpendicular to the rolling direction.

In view of the above, the frequency of the crystal grain boundaries in the direction orthogonal to the rolling direction, and the detachment conditions of the insulating tension coating were studied. As a result, it was discovered that, by limiting the frequency of crystal boundaries in the direction orthogonal to the rolling direction to 20 grain boundaries or less per unit length of 100 mm, i.e. 20 grain boundaries/100 mm or less, detachment of the insulating tension coating hardly occurs, and accordingly, lower iron loss can be achieved compared to conventional techniques, when magnetic domain refining treatment is performed under a condition in which the occurrence of coating detachment is minimized.

Grain-oriented electrical steel sheets manufactured under a condition satisfying $M2 \leq M1 \times 1.2$, $V(400\text{-}650) \leq 8°$ C./h, and $TiO_2$ addition amount≥5 parts by mass, were subjected to magnetic domain refining treatment by plasma flame irradiation under a coating detachment rate of 3% to 5%, and the relation between the frequency of grain boundaries of secondary recrystallized grains in the TD direction and iron loss $W_{17/50}$, was studied. The results are shown in FIG. 2 (excerpt from Example 2 described later).

Figure 2:
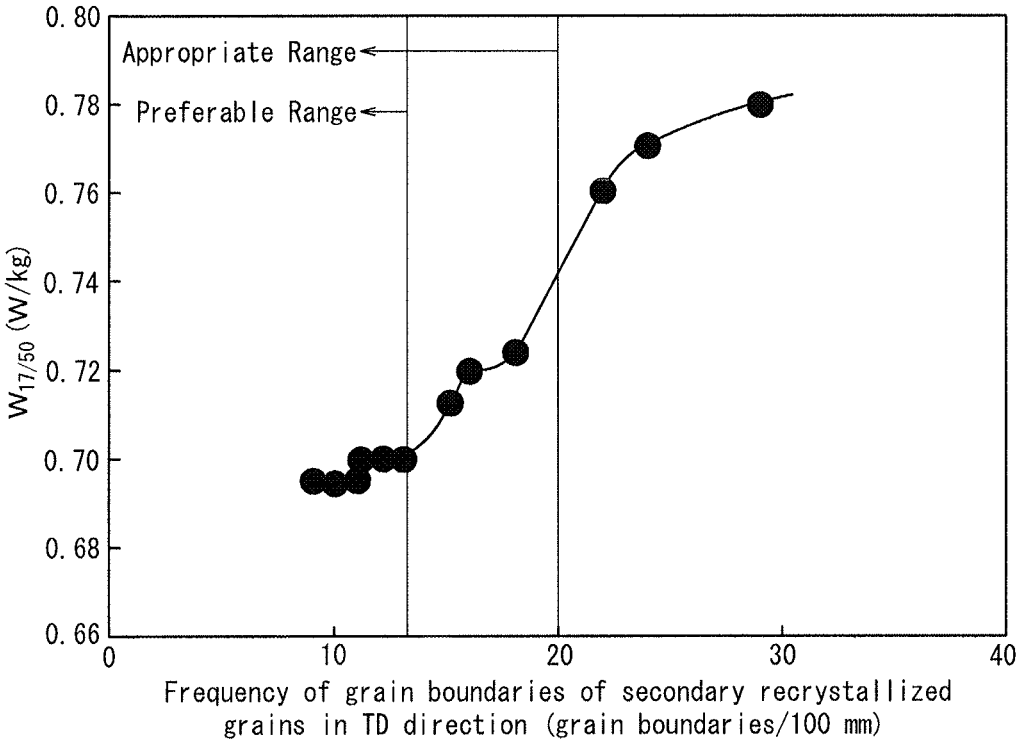
FIG. 2 shows the relation between the frequency of grain boundaries of secondary recrystallized grains in the TD direction and iron loss values $W_{17/50}$.

As shown in FIG. 2, it can be seen that, by setting the frequency of grain boundaries of secondary recrystallized grains in the direction orthogonal to the rolling direction to 20 grain boundaries/100 mm or less, low iron loss properties are obtained, and by setting said frequency to 13 grain boundaries/100 mm or less, even better low iron loss properties are obtained.

Ratio t(Fo)/t(C) of Mean Thickness t(Fo) of Forsterite Base Film to Thickness t(C) of Insulating Tension Coating: $t(Fo)/t(C) \geq 0.3$ By satisfying a sufficiently high ratio of the thickness t(Fo) of the base film with respect to the thickness t(C) of the insulating tension coating, the base film exhibits a sufficient effect as a binder of the base film, and the effect of preventing detachment of the insulating tension coating is increased. If t(Fo)/t(C) falls below 0.3, it is not possible to sufficiently mitigate the displacement and stress in the base film, which is caused when the insulating tension coating is thermally expanded by a local temperature increase during magnetic domain refining treatment, and coating detachment occurs more easily. For this reason, the above limitation was made.

If the value of t(Fo)/t(C) becomes excessively large, the irregularities in the interface between the forsterite and the steel substrate increases and deteriorates iron loss, and for this reason, the upper limit value of t(Fo)/t(C) is preferably around 2.0.

The thickness of the base film and that of the insulating tension coating were obtained by measuring the thickness in ten or more positions chosen from a micrograph of the cross section and calculating the mean thickness.

The base film has a structure extending into the steel substrate like branches, referred to as an anchor. In the disclosure, the mean thickness of the portion excluding the anchor in the photograph of the cross section was defined as the thickness of the base film.

Surface Roughness of Base Film: Arithmetic Mean Roughness Ra of 0.2 μm or More

By limiting the surface roughness of the base film to the above range, detachment at the interface between the base film and the insulating coating which occurs when the insulating tension coating is thermally expanded in magnetic domain refining treatment, is prevented. This is because the increase of roughness in the base film surface causes an increase of the area of the interface between the base film and the insulating coating. As for the surface roughness of the base film, the steel sheet was immersed in a heated sodium hydroxide aqueous solution to remove the insulating tension coating, measurement was performed using a normal roughness measuring method, and a mean value was obtained in the rolling direction and the direction orthogonal to the rolling direction.

If the surface roughness of the base film becomes excessive, irregularities at the interface between the forsterite and the steel substrate increase to thereby increase iron loss. Therefore, the upper limit value of Ra is preferably around 4.0 μm.

Ratio TE(Fo)/TE(C) of Tension TE(Fo) Applied by Forsterite Base Film to Steel Substrate (Per Surface) to Tension TE(C) Applied by Insulating Tension Coating to Steel Substrate (Per Surface): TE(Fo)/TE(C)≥0.1

As previously mentioned, in order to prevent coating detachment resulting from a local temperature increase of the steel sheet surface caused by magnetic domain refining treatment, it is preferable to sufficiently increase the strength of the base film. However, from the perspective of preventing coating detachment, it is not preferable to excessively increase the strength of the insulation coating itself. As indexes of the strength of the base film and that of the insulating tension coating, evaluation is preferably made based on the tensions that are applied by the base film and by the insulating tension coating to the steel sheet. From the perspective of preventing coating detachment, studies were made for the preferable ratio of TE(Fo) and TE(C), and it was discovered that by setting the ratios to satisfy TE(Fo)/TE(C)≥0.1, it is possible to effectively prevent detachment at the interface between the base film and the insulating coating resulting from the thermal expansion difference in the thickness direction created during the local temperature increase caused by magnetic domain refining treatment.

Further, if the value of TE(Fo)/TE(C) becomes excessively large, coating detachment may be caused by the tension difference, and therefore the upper limit value of TE(Fo)/TE(C) is preferably around 10.

The tension that is applied by the base film or the insulating tension coating to the steel substrate can be determined by removing the insulating coating or the base film and measuring the deflection of the steel sheet. Also applicable is a method of directly measuring the stress applied on the steel sheet by directly measuring the amount of strains from the changes caused in the insulating coating, the base film, and the lattice strains of the steel substrate.

Non-Heat Resistant Magnetic Domain Refining Treatment Performed by Electron Beam Irradiation When performing magnetic domain refining by linear electron beam irradiation, heat is generated in a deeper portion of the steel sheet compared to when using laser beam or plasma flame irradiation, and therefore it is advantageous to coating detachment. For this reason, when magnetic domain refining treatment is to be performed under a condition in which detachment of the insulating tension coating does not occur, it is possible to perform irradiation under conditions with a high magnetic domain refining effect, and an electron beam is more advantageous than a laser beam or a plasma flame. Therefore, as the more effective method, a method of using an electron beam is preferable.

Next, the method of manufacturing a grain-oriented electrical steel sheet of the disclosure will be described.

(i) Composition of Steel Slab

As used herein, the indication of "%" regarding components shall stand for "mass %" unless otherwise specified.

C: 0.001% to 0.20%

C not only improves the hot rolled texture by using transformation, but is also an element that is useful for generating nuclei of recrystallized grains in the Goss orientation, and it is preferably contained in an amount of 0.001% or more. However, if the content thereof exceeds 0.20%, it may cause decarburization failure during decarburization annealing, and therefore it is recommended that C be added in a range of 0.001% to 0.20%.

Si: 1.0% to 5.0%

Si is an effective element in terms of enhancing the electrical resistance of steel and improving iron loss properties. However, if the content thereof is lower than 1.0%, a sufficient iron loss reducing effect cannot be achieved. On the other hand, if the content thereof exceeds 5.0%, workability is significantly deteriorated and magnetic flux density may also be reduced. Therefore, the Si content is preferably in the range of 1.0% to 5.0%.

Mn: 0.01% to 1.0%

Mn is a necessary element in terms of improving hot workability. However, if the content thereof is lower than 0.01%, the effect obtained is limited. On the other hand, if the content thereof exceeds 1.0%, the magnetic flux density of the product steel sheet decreases. Therefore, the Mn content is preferably in the range of 0.01% to 1.0%.

S and/or Se: 0.005% to 0.040%

Se and S are useful components which form MnSe, MnS, $Cu_{2-X}Se_X$, and $Cu_{2-X}S_X$ when bonded to Mn or Cu, and exhibit an effect of an inhibitor as a dispersed second phase in steel. If the total content of Se and S is less than 0.005%, the effect obtained is limited. On the other hand, if the total content exceeds 0.040%, not only does the solution formation during slab heating become incomplete but it becomes the cause of defects on the product surface or secondary recrystallization failure. Therefore, in either case of independent addition or combined addition, the total content of one or both of S and Se is limited to a range of 0.005% to 0.040%.

sol.Al: 0.005% to 0.06%

Al is a useful element which forms AlN when bonded with N, and serves as an inhibitor as a dispersed second phase. However, if the Al content of the slab is lower than 0.005%, a sufficient precipitation amount cannot be guaranteed. Therefore, the secondary recrystallized grains become fine and the frequency of crystal grain boundaries crossing the region subjected to magnetic domain refining treatment increases. On the other hand, if Al is added in an amount exceeding 0.06%, AlN is formed as a coarse precipitate and dissipates the effect as an inhibitor, and causes deterioration of magnetic properties. Therefore, sol.Al content is limited to a range of 0.005% to 0.06%. Since AlN serves as a strong inhibitor, it is possible to increase the size of secondary crystallized grains and reduce the frequency of boundaries of secondary recrystallized grains in the direction orthogonal to the rolling direction. Further, if the suppressing effect obtained from AlN is not sufficient, using a combination of BN, Bi or the like as inhibitors enables sufficiently increasing the size of secondary recrystallized grains.

N: 0.002% to 0.020%

N is a necessary element for forming AlN by adding to steel simultaneously with Al. If the N content is lower than 0.002%, precipitation of AlN becomes insufficient and a sufficient inhibiting effect cannot be obtained. On the other hand, if N is added in an amount exceeding 0.020%, blistering or the like occurs during slab heating. Therefore, the N content is limited to a range of 0.0020% to 0.020%. Even if the N content as a slab component is small, it is possible to add nitrogen in the step where decarburization and nitriding treatment are combined.

As the steel slab composition, it is sufficient if the above components are contained. Additionally, for the purpose of enhancing the inhibiting effect and improving the recrystallized texture, one or more element selected from Sb: 0.005% to 0.2%, Cu: 0.05% to 2%, Sn: 0.01% to 1%, Ni: 0.1% to 3%, Bi: 0.0003% to 0.3%, B: 0.0003% to 0.02%, Ge: 0.05% to 2% and Cr: 0.02% to 2% may be added alone or in combination. If the amounts of adding these components are lower than the lower limit value, the effect as an inhibitor or the effect of improving recrystallized textures becomes insufficient. On the other hand, if these components are added in amounts exceeding the upper limit value, texture deterioration or the like occurs and deteriorates magnetic properties. Therefore, when using these auxiliary additive elements, they are preferably added in the above ranges.

(ii) Manufacturing Conditions

A steel slab adjusted to the above chemical composition is heated to a high temperature of 1350° C. or higher for the purpose of dissolving inhibitor components. However, if the inhibitor is to be supplemented in subsequent steps by nitriding or the like, the heating temperature may be 1280° C. or lower. The steel slab is then subjected to hot rolling to obtain a hot rolled sheet, and then the hot rolled sheet is subjected to a combination of annealing and cold rolling to obtain a cold rolled sheet with a final sheet thickness, and then the cold rolled sheet is subjected to decarburization and primary recrystallization annealing and subsequent final annealing, and then an insulating tension coating agent is applied and baked thereon to form insulating tension coating, and then the coated steel sheet is subjected to non-heat resistant magnetic domain refining treatment as necessary to obtain a product.

Any of the following methods may be used in the disclosure in order to obtain the final sheet thickness:

1) subjecting the slab to hot rolling to obtain a hot rolled steel sheet, and then subjecting the hot rolled steel sheet to hot band annealing, and to subsequent cold rolling twice or more with intermediate annealing performed therebetween to obtain a cold rolled sheet with final sheet thickness,
2) subjecting the slab to hot rolling to obtain a hot rolled steel sheet, and then subjecting the hot rolled steel sheet to hot band annealing, and to subsequent cold rolling once to obtain a cold rolled sheet with final sheet thickness, and
3) subjecting the slab to hot rolling to obtain a hot rolled steel sheet, and then subjecting the hot rolled steel sheet to cold rolling twice or more with intermediate annealing performed therebetween, without performing hot band annealing, to obtain a cold rolled sheet with final sheet thickness.

Further, for improving magnetic properties of the product, it is effective to create an oxidative annealing atmosphere by hot band annealing or intermediate annealing and subjecting the surface layer to light decarburization, increase solute C in steel by performing rapid cooling as the cooling process of annealing, and subsequently perform a treatment of maintaining a low temperature for precipitating fine carbides in steel, and this process may be performed as necessary. Further, performing cold rolling at a warm temperature of 100° C. to 300° C. and/or performing aging treatment between passes provides an advantageous effect on improving magnetic properties, and therefore they may be performed as necessary. Further, as it is commonly known, a technique of performing decarburization and primary recrystallization annealing, and then performing nitriding treatment where N is added to the steel in a range of 300 ppm or less by the time of starting secondary recrystallization is also effective for enhancing the inhibiting force. Therefore, by applying said technique to the disclosure, it is possible to manufacture a product excellent in both coating properties and magnetic properties.

The steel sheet is subjected to decarburization annealing and a subsequent application of an annealing separator, and then the steel sheet is subjected to final annealing and a subsequent application of an insulating coating, and then the steel sheet is subjected to flattening annealing where baking and flattening are combined to form an insulating coating thereon to obtain a product.

When performing non-heat resistant magnetic domain refining treatment by applying linear strains, thermal strains caused by linearly irradiating the steel sheet with a laser beam, plasma flame, or electron beam, after flattening annealing in the above process, at an angle within ±45° with respect to the direction perpendicular to the rolling direction of the steel sheet (C direction). The electrical steel sheet described herein can be applied to any of the following methods: a method in which a product is prepared from an electrical steel sheet without being subjected to magnetic domain refining treatment, and, depending on the magnetic properties required at the shipping destination, the product is subjected to magnetic domain refining treatment before shipment; a method in which a product is subjected to magnetic domain refining treatment at the processing manufacturer after shipment; and a method in which a product is subjected to magnetic domain refining treatment by the user before and after it is processed.

Requirements regarding the method of manufacturing the grain-oriented electrical steel sheet described herein, the reasons for the limitations thereof and preferable ranges will be described hereinafter.

$TiO_2$ is Added in an Amount of 5 Parts by Mass or More with Respect to 100 Parts by Mass of MgO which is the Main Component of Annealing Separator.

By adding $TiO_2$ to the annealing separator, larger amounts of TiN and $MgO.TiO_2$ form in the base film which is mainly composed of forsterite and a larger amount of Ti dissolves in grain boundaries, which increases the strength of the forsterite film and enables effectively preventing coating detachment in magnetic domain refining treatment. If the amount of $TiO_2$ added is less than 5 parts by mass with respect to 100 parts by mass of MgO, the above effect is not obtained. Therefore the amount of $TiO_2$ to be added is determined to be 5 parts by mass or more. Further, the upper limit of $TiO_2$ to be added is preferably 20 parts by mass.

As used herein, "main component" means that MgO accounts for 60% or more of the annealing separator, and preferably, MgO accounts for 80% or more of the annealing separator.

Further, as an additive to the annealing separator, various compounds such as Sr, Ca, Ba, B, Mg, Mo and Sn may be added in addition to the above $TiO_2$.

Application Amount of Annealing Separator: Coating Amount M1 Per Steel Sheet Surface After Application and Drying of 4 g/m$^2$ to 12 g/m$^2$ In order to sufficiently form a base film and guarantee the strength of the base film itself, it is necessary to control the coating amount of the annealing separator. If coating amount M1 of the annealing separator per steel sheet surface after application and drying is less than 4 g/m$^2$, the formation amount of the base film becomes insufficient, Ti in the base film required to satisfy formulas (1) and (2) cannot be guaranteed, and the coating strength becomes insufficient.

On the other hand, if the coating amount M1 of the annealing separator exceeds 12 g/m$^2$, the decomposition rate of the inhibitor becomes excessive, and causes failure of magnetic properties. Therefore, it is necessary for the annealing separator to be applied in an amount such that the coating amount M1 per steel sheet surface after application and drying is in a range of 4 g/m$^2$ to 12 g/m$^2$.

Heating Rate V(400-650) Between 400° C. and 650° C.: 8° C./h or Higher

By avoiding gradual heating in the temperature range of 400° C. to 650° C. during the heating process of final annealing, it is possible to obtain a product satisfying the condition of formula (2) i.e. FX(Ti)/FX(Fe)≥0.004. This is considered to be because, by suppressing the reaction between $H_2O$ released from the hydrated water of MgO and Fe which is easily caused in this temperature range, and preventing the additional oxidation caused by the re-release of $H_2O$ in a high temperature range to facilitate a uniform coating formation, the amount of Fe contained in the base film can be reduced.

Figure 3:
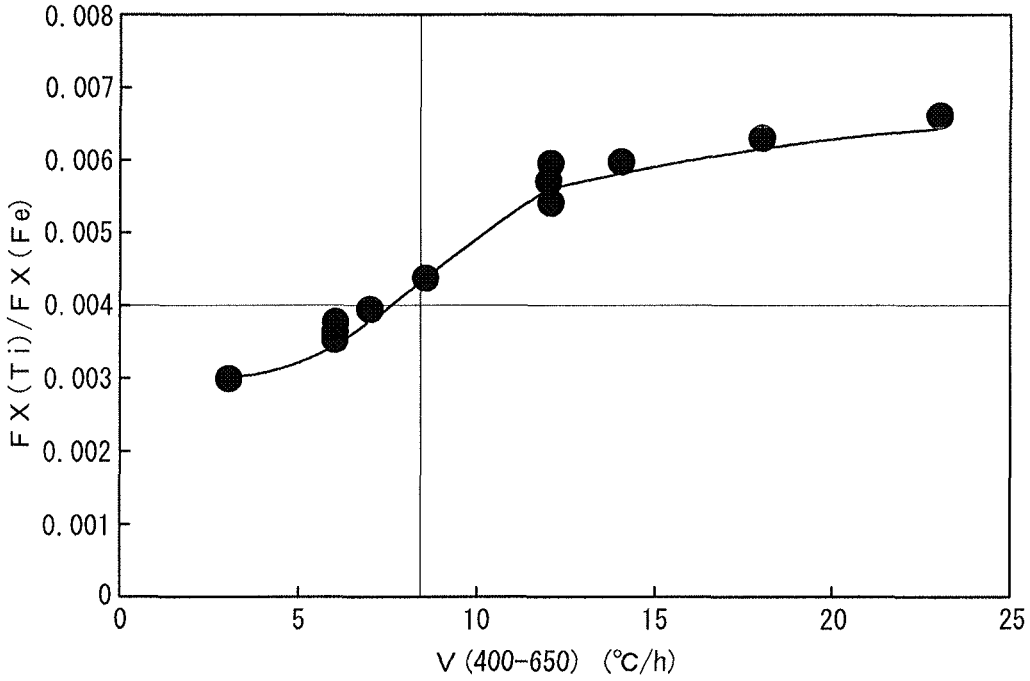
FIG. 3 shows the relation between V(400-650) and FX(Ti)/FX(Fe)

FIG. 3 shows the results of studying the relation between V(400-650) and FX(Ti)/FX(Fe) (excerpt from example 2 described later).

As shown in FIG. 3, by setting V(400-650) to 8° C./h or higher, FX(Ti)/FX(Fe)≥0.004 is achieved.

Although there is no particular upper limit for V(400-650), an excessively high V(400-650) increases the occurrence frequency of secondary recrystallized grains with undesired orientation and deteriorates magnetic properties, and therefore the upper limit is preferably around 50° C./h.

Ratio V(400-650)/V(700-850) of Heating Rate V(400-650) Between 400° C. and 650° C. to Heating Rate V(700-850) Between 700° C. and 850° C.: 3.0 or More The annealing conditions during final annealing have an influence on the frequency of secondary recrystallized grain boundaries (crystallized grain size) and the condition of the base film. In final annealing, a base film satisfying formulas (1) and (2) can be formed by increasing the heating rate between 400° C. and 650° C. depending on the heating rate between 700° C. and 850° C. to limit the grain boundary frequency of secondary recrystallized grains in the direction orthogonal to the rolling direction to 20 grain boundaries/100 mm or less, and simultaneously controlling the components of the annealing separator and the conditions regarding the coating amount of the base film.

It is considered that the above conditions for the heating process of final annealing optimize the inhibitor distribution in the primary recrystallized texture and the grain size distribution of the primary recrystallized grains right before the secondary recrystallization started at around 900° C., and as a result, secondary recrystallized grains with a good orientation and a coarse grain size can be obtained.

Further, it is considered that by performing rapid heating in the low temperature range and gradual heating in the high temperature range, the formation reaction of TiN and $MgO.TiO_2$ in forsterite is appropriately controlled, and the decomposition of AlN and accumulation thereof in forsterite is suppressed, and as a result, a base film satisfying formulas (1) and (2) is obtained.

Figure 4:
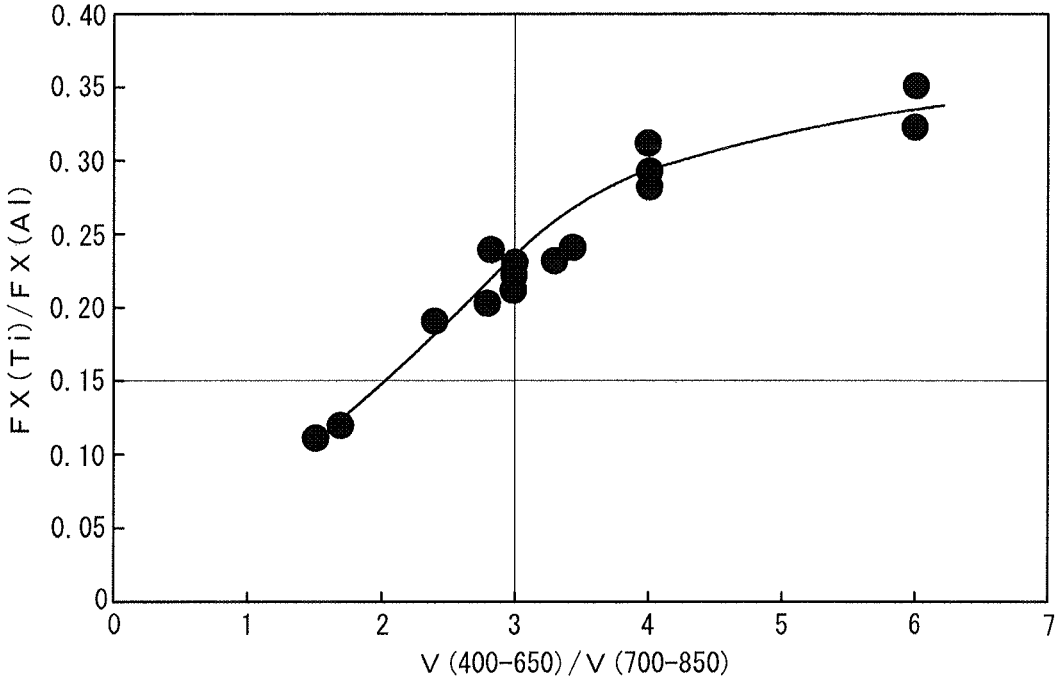
FIG. 4 shows the relation between V(400-650)/V(700-850) and FX(Ti)/FX(Al)
Figure 5:
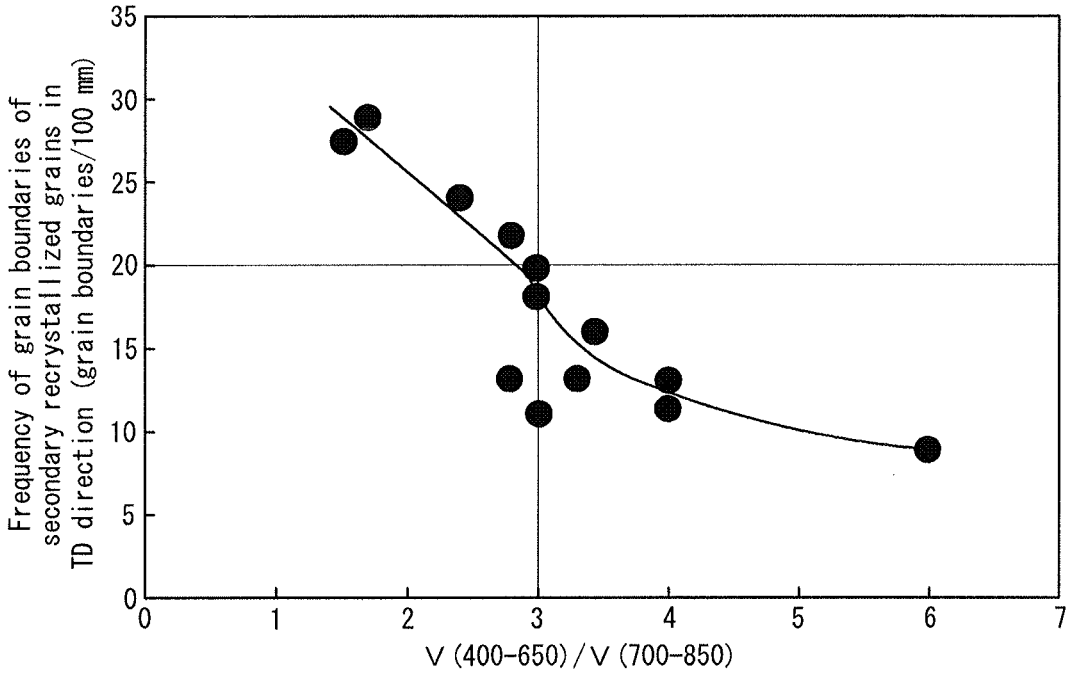
FIG. 5 shows the relation between V(400-650)/V(700-850) and the frequency of grain boundaries of secondary recrystallized grains in the TD direction.

FIGS. 4 and 5 each show the results of studying the relation between V(400-650)/V(700-850) and FX(Ti)/FX(Al), and the relation between V(400-650)/V(700-850) and the grain boundary frequency of secondary recrystallized grain in the direction orthogonal to the rolling direction (excerpt from example 2 described later).

As shown in FIGS. 4 and 5, it can be seen that, by setting V(400-650)/V(700-850) to 3.0 or more, it is possible to stably satisfy FX(Ti)/FX(Al)≥0.15 and a grain boundary frequency of secondary recrystallized grains of 20 grain boundaries/100 mm or less.

For this reason, V(400-650)/V(700-850) was determined to be 3.0 or more. The upper limit value of the ratio is preferably around 20 from the perspective of suppressing generation of undesired secondary recrystallization orientation.

Coating Amount M2 (g/m$^2$) Per Steel Sheet Surface After Application and Drying of Insulating Tension Coating with Respect to Coating Amount M1 (g/m$^2$) Per Steel Sheet Surface After Application and Drying of Annealing Separator: M2≤M1×1.2

In order to set the ratio t(Fo)/t(C) of mean thickness t(Fo) of forsterite base film to thickness t(C) of insulating tension coating to 0.3 or more, it is necessary to control the coating amount of an insulating tension coating depending on the coating amount of the annealing separator applied during final annealing.

As a result of studying the appropriate coating amounts of the insulating tension coating and of the annealing separator, it was discovered that it is necessary for the coating amounts M1 and M2 after application and drying to be in a range satisfying M2≤M1×1.2. The lower limit of M2 content is preferably 2 g/m$^2$.

Cl Content in Annealing Separator: 0.005 Parts by Mass to 0.1 Parts by Mass with Respect to 100 Parts by Mass of MgO By setting the coating amount M1 (per surface) after application and drying of the annealing separator used for final annealing to 4 g/m$^2$ or more, and by containing, in a mass ratio, Cl in a range of 0.005 parts by mass to 0.1 parts by mass with respect to 100 parts by mass of MgO in the annealing separator, the activity of MgO increases and the base film formed during final annealing develops into a sufficient thickness.

At the same time, since Cl increases the surface roughness of the base film, it contributes to the prevention of detachment of the insulating tension coating during magnetic domain refining treatment. In this regard, if the Cl content in the annealing separator is less than 0.005 parts by mass, the effect of facilitating formation of the base film and the effect of increasing the roughness of the base film surface is insufficient. However, Cl content exceeding 0.1 parts by mass causes coating failure.

Further, by setting the hydration rate of MgO used as the annealing separator to 2% to 4%, it is possible to achieve a desirable surface roughness Ra of the base film of 0.25 μm or more. It is considered that, by setting the water content added as hydrated water of MgO to a certain content or more, Fe oxidizes in a low temperature range and forms (Mg,Fe)O, $H_2O$ is re-produced during reduction caused by the $H_2$ atmosphere in a high temperature range and additional oxidation occurs in which oxidation proceeds, and due to the rapidly proceeding oxidation reaction in the high temperature range, the unevenness in the surface layer of the base film increases and a roughness Ra of 0.25 μm or more is achieved. Therefore, the water content introduced between coil layers during final annealing by the appropriately high activity of MgO needs to be set to an appropriate value, and to this end, the hydration rate of MgO (20° C., 60 minutes) is preferably 2% or more. However, an excessively high hydration rate of MgO facilitates decomposition of the inhibitor near the surface layer part of the steel sheet by additional oxidation and secondary recrystallization failure easily occurs. Therefore, the hydration rate of MgO (20° C., 60 minutes) is preferably 4% or less.

Maximum Temperature $T_{FN}$ (° C.) During Flattening Annealing: 780° C. to 850° C., Mean Tension S Between ($T_{FN}$—10° C.) and $T_{FN}$: 5 MPa to 11 MPa In flattening annealing, tension is applied to a steel sheet at a high temperature to apply minute elongation strains to the steel sheet and to perform flattening thereof. Although most of the dislocations caused by elongation strains are released by the high temperature range, iron loss properties deteriorate even if only a small part of such dislocations remain. At the same time, the elongation of the steel substrate part reduces the tension applied by the base film and the insulating tension coating. Therefore, it is desirable that the elongation strains in flattening annealing be minimized to the amount required for flattening the steel sheet.

From the perspective of minimizing the residual amount of dislocations caused by flattening annealing and preventing the reduction of tension of the base film and the insulating tension coating, the conditions for flattening annealing are specified. Here, if the maximum temperature of flattening annealing is lower than 780° C. or if the mean tension S between ($T_{FN}$—10° C.) and $T_{FN}$ is lower than 5 MPa, a problem occurs with the flatness of the steel sheet. On the other hand, if the maximum temperature $T_{FN}$ exceeds 850° C., or the mean tension S between ($T_{FN}$—10° C.) and $T_{FN}$ exceeds 11 MPa, elongation deformation becomes excessive. Therefore, regarding the conditions of flattening annealing, $T_{FN}$ (° C.) is preferably limited to 780° C. to 850° C. and the mean tension S between ($T_{FN}$—10° C.) and $T_{FN}$ is preferably limited to 5 MPa to 11 MPa.

Maximum Temperature $T_{FN}$ (° C.) in Flattening Annealing and Mean Tension S (MPa) Between ($T_{FN}$—10° C.) and $T_{FN}$ Satisfy a Range of $6500 \leq T_{FN} \times S \leq 9000$.

The holding time at the maximum temperature and the tension applied to the steel sheet both have an influence on elongation strains applied to the steel sheet in flattening annealing, and the degree of the influence can be specified by the product of said temperature and said tension applied.

If $T_{FN} \times S$ is less than 6500, the effect of flattening is not sufficient, whereas if $T_{FN} \times S$ is more than 9000, elongation deformation becomes excessive.

Insulating Tension Coating

As insulating tension coating, a vitreous coating mainly composed of colloidal silica, magnesium phosphate, or aluminum phosphate is excellent in terms of product characteristics and economical efficiency. Further, with such coating, it is relatively easy to control conditions to satisfy those specified in formulas (3) and (4).

Non-Heat Resistant Magnetic Domain Refining Treatment: Electron Beam Irradiation In electron beam irradiation, accelerated electrons are injected into the steel sheet, and kinetic energy is converted into heat energy at the site where the electrons stop moving. This causes heat to be generated in a position deeper in the thickness direction of the steel sheet compared to when using a laser beam or plasma flame, and therefore detachment hardly occurs between the insulating tension coating and the base film, or between the base film and the steel substrate. Therefore, electron beam irradiation is suitable as a method of achieving a high iron loss improving effect without coating detachment, and is recommended as the non-heat resistant magnetic domain refining method of the disclosure.

EXAMPLES

Example 1

Steel slabs with various chemical compositions shown in Table 1 were heated to 1410° C., subjected to hot rolling to obtain hot rolled steel sheets with thickness of 2.4 mm, then the hot rolled steel sheets were subjected to hot band annealing at 1050° C. for 30 seconds, subsequent pickling, and then subjected to the first cold rolling to obtain cold rolled steel sheets with thickness of 2.0 mm, which in turn were subjected to intermediate annealing at 1100° C. for 2 minutes, and then to the second cold rolling where the steel sheet temperature right after rolling reaches 210° C. to obtain cold rolled steel sheets with a thickness of 0.23 mm. Then, decarburization/primary recrystallization annealing which is a combination of decarburization and primary recrystallization annealing, in which the cold rolled steel sheets are held in a mixed atmosphere of nitrogen, hydrogen, and vapor at 850° C. for 4 minutes was performed.

Then, an annealing separator (Cl content being 0.02 parts by mass per 100 parts by mass of MgO) in which 8 parts by mass of $TiO_2$ is contained per 100 parts by mass of MgO which is the main component was applied to the steel sheets so that the coating amount M1 (per steel sheet surface) after application and drying is 10 g/m$^2$, and in turn, the steel sheets were wound into a coil, and then subjected to final annealing with a heating rate V (400-650) between 400° C. and 650° C. of 12° C./h and a heating rate V (700-850) between 700° C. and 850° C. of 3° C./h. Then, insulating tension coating mainly composed of magnesium phosphate and colloidal silica with chromic acid added thereto was applied on the steel sheets so that the coating amount M2 (per steel sheet surface) after flattening annealing is 5 g/m$^2$, and in turn, the steel sheets were subjected to continuous annealing in which flattening annealing and baking of insulating tension coating are performed under the conditions of maximum temperature $T_{FN}$: 850° C., and mean tension S between ($T_{FN}$—10° C.) and $T_{FN}$: 6 MPa.

Then, magnetic domain refining treatment was performed with a laser beam. Here, the output of the laser beam to each steel sheet was adjusted in a range where detachment of the insulating tension coating is not caused by said irradiation. The intervals of the laser beam were set to 6 mm and irradiation was performed at an angle of 10° with respect to the direction orthogonal to the rolling direction. The detachment rate was specified as the ratio of the length of the detached part to the whole length of the laser beam irradiated part.

Using products obtained as above, SST test pieces were cut out, and measured for their magnetic properties using an SST tester (JISC 2556).

The obtained results are shown in Table 2. Table 2 also shows FX(Ti)/FX(Al) and FX(Ti)/FX(Fe) obtained through quantitative analysis by applying correction with the ZAF method to results of fluorescent X-ray analysis, and the results of studying the frequency of grain boundaries of secondary recrystallized grains in the TD direction, t(Fo)/t(C), and the surface roughness of the base film.

TABLE 1

| | Chemical Composition (mass %) | | | | | | | | | |
|---|---|---|---|---|---|---|---|---|---|---|
| No. | C | Si | Mn | S | Se | S + Se | sol · Al | N | Others | Remarks |
| 1 | 0.08 | 3.3 | 0.09 | — | 0.020 | 0.020 | 0.004 | 0.0050 | — | Comparative Steel |
| 2 | 0.08 | 3.3 | 0.09 | — | 0.020 | 0.020 | 0.006 | 0.0050 | — | Applicable Steel |
| 3 | 0.08 | 3.3 | 0.09 | — | 0.020 | 0.020 | 0.020 | 0.0050 | — | Applicable Steel |
| 4 | 0.08 | 3.3 | 0.09 | — | 0.020 | 0.020 | 0.060 | 0.0050 | — | Applicable Steel |
| 5 | 0.08 | 3.3 | 0.09 | — | 0.020 | 0.020 | 0.070 | 0.0050 | — | Comparative Steel |
| 6 | 0.08 | 3.3 | 0.09 | — | 0.020 | 0.020 | 0.030 | 0.0015 | — | Comparative Steel |
| 7 | 0.08 | 3.3 | 0.09 | — | 0.020 | 0.020 | 0.010 | 0.0030 | — | Applicable Steel |
| 8 | 0.08 | 3.3 | 0.09 | — | 0.020 | 0.020 | 0.030 | 0.0200 | — | Applicable Steel |
| 9 | 0.08 | 3.3 | 0.09 | — | 0.004 | 0.004 | 0.030 | 0.0090 | — | Comparative Steel |
| 10 | 0.08 | 3.3 | 0.09 | — | 0.006 | 0.006 | 0.030 | 0.0090 | — | Applicable Steel |
| 11 | 0.08 | 3.3 | 0.09 | — | 0.040 | 0.040 | 0.030 | 0.0090 | — | Applicable Steel |
| 12 | 0.08 | 3.3 | 0.09 | — | 0.050 | 0.050 | 0.030 | 0.0090 | — | Comparative Steel |
| 13 | 0.08 | 3.3 | 0.09 | 0.004 | — | 0.004 | 0.030 | 0.0090 | — | Comparative Steel |
| 14 | 0.08 | 3.3 | 0.09 | 0.010 | — | 0.010 | 0.030 | 0.0090 | — | Applicable Steel |
| 15 | 0.08 | 3.3 | 0.09 | 0.050 | — | 0.050 | 0.030 | 0.0090 | — | Comparative Steel |
| 16 | 0.08 | 3.3 | 0.09 | 0.020 | 0.020 | 0.040 | 0.030 | 0.0090 | — | Applicable Steel |
| 17 | 0.08 | 3.3 | 0.09 | 0.025 | 0.025 | 0.050 | 0.030 | 0.0090 | — | Comparative Steel |
| 18 | 0.08 | 3.3 | 0.09 | 0.020 | 0.020 | 0.040 | 0.030 | 0.0090 | Sb: 0.05 | Applicable Steel |
| 19 | 0.08 | 3.3 | 0.09 | 0.020 | 0.020 | 0.040 | 0.030 | 0.0090 | Cu: 0.05 | Applicable Steel |
| 20 | 0.08 | 3.3 | 0.09 | 0.020 | 0.020 | 0.040 | 0.030 | 0.0090 | Sn: 0.05 | Applicable Steel |
| 21 | 0.08 | 3.3 | 0.09 | 0.020 | 0.020 | 0.040 | 0.030 | 0.0090 | Ni: 0.5 | Applicable Steel |
| 22 | 0.08 | 3.3 | 0.09 | 0.020 | 0.020 | 0.040 | 0.030 | 0.0090 | Bi: 0.02 | Applicable Steel |
| 23 | 0.08 | 3.3 | 0.09 | 0.020 | 0.020 | 0.040 | 0.030 | 0.0090 | B: 0.005 | Applicable Steel |
| 24 | 0.08 | 3.3 | 0.09 | 0.020 | 0.020 | 0.040 | 0.030 | 0.0090 | Ge: 0.1 | Applicable Steel |
| 25 | 0.08 | 3.3 | 0.09 | 0.020 | 0.020 | 0.040 | 0.030 | 0.0090 | Cr: 0.5 | Applicable Steel |

Underlined values are outside of the appropriate range.

TABLE 2

| No. | FX(Ti)/FX(Al) | FX(Ti)/FX(Fe) | Frequency of Grain Boundaries of Secondary Recrystallized Grains in TD Direction (Grain Boundaries/100 mm) | t(Fo)/t(C) | Surface Roughness Ra of Base Film (μm) | $B_8$ (T) | $W_{17/50}$ (W/kg) | Remarks |
|---|---|---|---|---|---|---|---|---|
| 1 | 0.36 | 0.0075 | 18 | 0.69 | 0.24 | 1.90 | 0.91 | Comparative Example |
| 2 | 0.33 | 0.0076 | 18 | 0.68 | 0.24 | 1.90 | 0.79 | Example |

TABLE 2-continued

| No. | FX(Ti)/FX(Al) | FX(Ti)/FX(Fe) | Frequency of Grain Boundaries of Secondary Recrystallized Grains in TD Direction (Grain Boundaries/100 mm) | t(Fo)/t(C) | Surface Roughness Ra of Base Film (μm) | $B_8$ (T) | $W_{17/50}$ (W/kg) | Remarks |
|---|---|---|---|---|---|---|---|---|
| 3 | 0.32 | 0.0079 | 13 | 0.68 | 0.23 | 1.93 | 0.71 | Example |
| 4 | 0.29 | 0.0073 | 11 | 0.68 | 0.23 | 1.94 | 0.69 | Example |
| 5 | 0.26 | 0.0073 | 22 | 0.68 | 0.25 | 1.85 | 1.25 | Comparative Example |
| 6 | 0.31 | 0.0074 | 31 | 0.67 | 0.23 | 1.87 | 1.03 | Comparative Example |
| 7 | 0.33 | 0.0075 | 17 | 0.68 | 0.24 | 1.90 | 0.75 | Example |
| 8 | 0.35 | 0.0078 | 12 | 0.68 | 0.24 | 1.93 | 0.70 | Example |
| 9 | 0.34 | 0.0075 | 25 | 0.67 | 0.26 | 1.88 | 0.92 | Comparative Example |
| 10 | 0.34 | 0.0074 | 14 | 0.67 | 0.25 | 1.91 | 0.79 | Example |
| 11 | 0.35 | 0.0074 | 12 | 0.66 | 0.25 | 1.93 | 0.71 | Example |
| 12 | 0.33 | 0.0075 | 13 | 0.64 | 0.25 | 1.87 | 1.02 | Comparative Example |
| 13 | 0.32 | 0.0076 | 27 | 0.66 | 0.24 | 1.87 | 1.01 | Comparative Example |
| 14 | 0.33 | 0.0076 | 20 | 0.65 | 0.23 | 1.93 | 0.72 | Example |
| 15 | 0.31 | 0.0074 | 16 | 0.63 | 0.25 | 1.86 | 1.12 | Comparative Example |
| 16 | 0.34 | 0.0072 | 10 | 0.64 | 0.24 | 1.93 | 0.70 | Example |
| 17 | 0.32 | 0.0075 | 15 | 0.62 | 0.25 | 1.85 | 1.22 | Comparative Example |
| 18 | 0.32 | 0.0069 | 16 | 0.59 | 0.23 | 1.94 | 0.69 | Example |
| 19 | 0.33 | 0.0071 | 15 | 0.64 | 0.27 | 1.93 | 0.70 | Example |
| 20 | 0.31 | 0.0068 | 19 | 0.58 | 0.24 | 1.93 | 0.70 | Example |
| 21 | 0.34 | 0.0072 | 15 | 0.66 | 0.26 | 1.94 | 0.69 | Example |
| 22 | 0.32 | 0.0065 | 8 | 0.55 | 0.24 | 1.96 | 0.66 | Example |
| 23 | 0.32 | 0.0073 | 15 | 0.63 | 0.23 | 1.93 | 0.70 | Example |
| 24 | 0.33 | 0.0073 | 14 | 0.60 | 0.24 | 1.93 | 0.71 | Example |
| 25 | 0.35 | 0.0078 | 17 | 0.73 | 0.28 | 1.93 | 0.69 | Example |

Underlined values are outside of the appropriate range.

As shown in table 2, every product steel sheet obtained in accordance with the disclosure achieved very low iron loss values.

Example 2

Steel slabs, each having a composition containing C: 0.090%, Si: 3.3%, Mn: 0.10%, Se: 0.020%, sol.Al: 0.030%, N: 0.0090%, Sb: 0.040%, Cu: 0.05% and Cr: 0.10%, and the balance being Fe and incidental impurities, were each heated to 1420° C., subjected to hot rolling to obtain hot rolled sheets with a thickness of 1.8 mm. Then, each hot rolled steel sheet was subjected to hot band annealing at 1075° C. for 30 seconds and subsequent pickling, and then subjected to the first cold rolling where the temperature of the steel strip reaches 200° C. to obtain a cold rolled sheet with a thickness of 0.35 mm, which in turn was wound into a coil and subjected to aging treatment at 300° C. for 5 hours, and then subjected to the second cold rolling to obtain a final cold rolled sheet with a thickness of 0.23 mm. Then, decarburization/primary recrystallization annealing which is a combination of decarburization and primary recrystallization, in which the cold rolled sheet is held in a mixed atmosphere of nitrogen, hydrogen, and vapor at 830° C. for 2 minutes was performed.

Then, under the conditions shown in Table 3, an annealing separator was applied to each steel sheet, which in turn was wound into a coil and subjected to final annealing, and to subsequent flattening annealing for the purpose of applying and baking an insulating tension coating treatment agent mainly composed of magnesium phosphate and colloidal silica with chromic acid added thereto.

Then, magnetic domain refining treatment was performed with a plasma flame. Here, the output of the plasma flame to each steel sheet was adjusted so that the coating rate of insulating tension coating caused by the irradiation was 3% to 5%. The detachment rate was specified as the ratio of the length of the detached part to the whole length of the plasma flame irradiated part. In magnetic domain refining treatment, the intervals were set to 6 mm and irradiation was performed at an angle of 10° with respect to the direction orthogonal to the rolling direction, and an aluminum phosphate-based organic coating was applied and baked at 350° C.

Using products obtained as above, SST test pieces were cut out, and measured for their magnetic properties using an SST tester (JISC 2556).

The obtained results are shown in Table 4. Table 4 also shows FX(Ti)/FX(Al) and FX(Ti)/FX(Fe) obtained through quantitative analysis by applying correction with the ZAF method to results of fluorescent X-ray analysis, and the results of studying the frequency of grain boundaries of secondary recrystallized grains in the direction orthogonal to the rolling direction (TD direction), t(Fo)/t(C), the surface roughness of the base film, and TE(Fo)/TE(C).

TABLE 3

| No. | Coating Amount M1 of Annealing Separator ($g/m^2$) | Amount of $TiO_2$ Added with respect to MgO (parts by mass) | Amount of Cl Added with respect to MgO (parts by mass) | Coating Amount M2 of Insulating Tension Coating ($g/m^2$) | V(400-650) (° C./h) | V(700-850) (° C./h) | V(400-650)/V(700-850) | Maximum Temperature $T_{FN}$ (° C.) | Mean Tension S between ($T_{FN}$ − 10° C.) and $T_{FN}$ (MPa) | $T_{FN}$ × S (° C. · MPa) | Remarks |
|---|---|---|---|---|---|---|---|---|---|---|---|
| 1 | 3 | 6 | 0.004 | 4.5 | 12 | 3 | 4 | 850 | 11 | 9350 | Comparative Example |
| 2 | 4 | 6 | 0.004 | 4.5 | 12 | 3 | 4 | 850 | 11 | 9350 | Example |
| 3 | 8 | 6 | 0.004 | 4.5 | 12 | 3 | 4 | 850 | 11 | 9350 | Example |
| 4 | 12 | 6 | 0.004 | 4.5 | 12 | 3 | 4 | 850 | 11 | 9350 | Example |
| 5 | 14 | 6 | 0.004 | 4.5 | 12 | 3 | 4 | 850 | 11 | 9350 | Comparative Example |
| 6 | 10 | 6 | 0.004 | 7.5 | 12 | 3 | 4 | 850 | 11 | 9350 | Example |
| 7 | 6 | 6 | 0.004 | 7.5 | 12 | 3 | 4 | 850 | 11 | 9350 | Comparative Example |
| 8 | 5 | 6 | 0.004 | 7.5 | 12 | 3 | 4 | 850 | 11 | 9350 | Comparative Example |
| 9 | 6 | 6 | 0.004 | 4.5 | 12 | 7 | 1.7 | 850 | 11 | 9350 | Comparative Example |
| 10 | 6 | 6 | 0.004 | 4.5 | 12 | 5 | 2.4 | 850 | 11 | 9350 | Comparative Example |
| 11 | 6 | 6 | 0.004 | 4.5 | 14 | 5 | 2.8 | 850 | 11 | 9350 | Comparative Example |
| 12 | 6 | 6 | 0.004 | 4.5 | 12 | 4 | 3.0 | 850 | 11 | 9350 | Example |
| 13 | 6 | 6 | 0.004 | 4.5 | 12 | 3.5 | 3.4 | 850 | 11 | 9350 | Example |
| 14 | 6 | 6 | 0.004 | 4.5 | 12 | 3 | 4.0 | 850 | 11 | 9350 | Example |
| 15 | 6 | 6 | 0.004 | 4.5 | 12 | 2 | 6.0 | 850 | 11 | 9350 | Example |
| 16 | 6 | 6 | 0.004 | 4.5 | 18 | 4.5 | 4.0 | 850 | 11 | 9350 | Example |
| 17 | 6 | 6 | 0.004 | 4.5 | 23 | 7 | 3.3 | 850 | 11 | 9350 | Example |
| 18 | 6 | 6 | 0.004 | 4.5 | 8 | 2.5 | 3.2 | 850 | 11 | 9350 | Example |
| 19 | 6 | 6 | 0.004 | 4.5 | 6 | 1 | 6.0 | 850 | 11 | 9350 | Comparative Example |
| 20 | 6 | 6 | 0.004 | 4.5 | 6 | 1.5 | 4.0 | 850 | 11 | 9350 | Comparative Example |
| 21 | 6 | 6 | 0.004 | 4.5 | 6 | 2 | 3.0 | 850 | 11 | 9350 | Comparative Example |
| 22 | 6 | 6 | 0.004 | 4.5 | 6 | 4 | 1.5 | 850 | 11 | 9350 | Comparative Example |
| 23 | 6 | 6 | 0.004 | 4.5 | 3 | 1 | 3.0 | 850 | 11 | 9350 | Comparative Example |
| 24 | 6 | 2 | 0.004 | 4.5 | 12 | 3 | 4.0 | 850 | 11 | 9350 | Comparative Example |
| 25 | 6 | 3 | 0.004 | 4.5 | 12 | 3 | 4.0 | 850 | 11 | 9350 | Comparative Example |
| 26 | 6 | 5 | 0.004 | 4.5 | 12 | 3 | 4.0 | 850 | 11 | 9350 | Example |
| 27 | 6 | 7 | 0.004 | 4.5 | 12 | 3 | 4.0 | 850 | 11 | 9350 | Example |
| 28 | 6 | 10 | 0.004 | 4.5 | 12 | 3 | 4.0 | 850 | 11 | 9350 | Example |
| 29 | 6 | 6 | 0.005 | 4.5 | 12 | 3 | 4.0 | 850 | 11 | 9350 | Example |
| 30 | 6 | 6 | 0.010 | 4.5 | 12 | 3 | 4.0 | 850 | 11 | 9350 | Example |
| 31 | 6 | 6 | 0.030 | 4.5 | 12 | 3 | 4.0 | 850 | 11 | 9350 | Example |
| 32 | 6 | 6 | 0.100 | 4.5 | 12 | 3 | 4.0 | 850 | 11 | 9350 | Example |
| 33 | 6 | 6 | 0.030 | 4.5 | 12 | 3 | 4.0 | 850 | 12 | 10200 | Example |
| 34 | 6 | 6 | 0.030 | 4.5 | 12 | 3 | 4.0 | 850 | 10 | 8500 | Example |
| 35 | 6 | 6 | 0.030 | 4.5 | 12 | 3 | 4.0 | 850 | 10 | 8500 | Example |
| 36 | 6 | 6 | 0.030 | 4.5 | 12 | 3 | 4.0 | 850 | 9 | 7225 | Example |

Underlined values are outside of the appropriate range.

TABLE 4

| No. | FX(Ti)/FX(Al) | FX(Ti)/FX(Fe) | Frequency of Grain Boundaries of Secondary Recrystallized Grains in TD Direction (Grain Boundaries/100 mm) | t(Fo)/t(C) | Surface Roughness Ra of Base Film (μm) | TE(Fo)/TE(C) | $B_8$ (T) | $W_{17/50}$ (W/kg) | Remarks |
|---|---|---|---|---|---|---|---|---|---|
| 1 | 0.12 | 0.0031 | 9 | 0.22 | 0.21 | 0.11 | 1.92 | 0.83 | Comparative Example |
| 2 | 0.15 | 0.0053 | 12 | 0.31 | 0.22 | 0.11 | 1.93 | 0.70 | Example |
| 3 | 0.23 | 0.0064 | 10 | 0.43 | 0.18 | 0.11 | 1.93 | 0.69 | Example |
| 4 | 0.29 | 0.0076 | 12 | 0.49 | 0.18 | 0.12 | 1.92 | 0.70 | Example |
| 5 | 0.29 | 0.0085 | 13 | 0.50 | 0.18 | 0.08 | 1.85 | 1.15 | Comparative Example |
| 6 | 0.29 | 0.0063 | 12 | 0.44 | 0.18 | 0.08 | 1.93 | 0.70 | Example |
| 7 | 0.29 | 0.0063 | 9 | 0.27 | 0.18 | 0.08 | 1.93 | 0.77 | Comparative Example |

TABLE 4-continued

| No. | FX(Ti)/ FX(Al) | FX(Ti)/ FX(Fe) | Frequency of Grain Boundaries of Secondary Recrystallized Grains in TD Direction (Grain Boundaries/100 mm) | t(Fo)/ t(C) | Surface Roughness Ra of Base Film (μm) | TE(Fo) / TE(C) | $B_8$ (T) | $W_{17/50}$ (W/kg) | Remarks |
|---|---|---|---|---|---|---|---|---|---|
| 8 | 0.29 | 0.0062 | 10 | 0.23 | 0.18 | 0.08 | 1.93 | 0.78 | Comparative Example |
| 9 | 0.12 | 0.0057 | 29 | 0.40 | 0.21 | 0.08 | 1.93 | 0.78 | Comparative Example |
| 10 | 0.19 | 0.0058 | 24 | 0.40 | 0.18 | 0.08 | 1.93 | 0.77 | Comparative Example |
| 11 | 0.20 | 0.0060 | 22 | 0.41 | 0.18 | 0.08 | 1.93 | 0.76 | Comparative Example |
| 12 | 0.22 | 0.0059 | 18 | 0.41 | 0.20 | 0.08 | 1.94 | 0.72 | Example |
| 13 | 0.24 | 0.0057 | 16 | 0.40 | 0.21 | 0.08 | 1.94 | 0.72 | Example |
| 14 | 0.29 | 0.0055 | 11 | 0.42 | 0.20 | 0.11 | 1.94 | 0.70 | Example |
| 15 | 0.35 | 0.0057 | 9 | 0.41 | 0.22 | 0.11 | 1.93 | 0.70 | Example |
| 16 | 0.31 | 0.0063 | 11 | 0.42 | 0.21 | 0.11 | 1.93 | 0.70 | Example |
| 17 | 0.23 | 0.0067 | 13 | 0.44 | 0.21 | 0.11 | 1.93 | 0.70 | Example |
| 18 | 0.24 | 0.0042 | 13 | 0.43 | 0.22 | 0.08 | 1.93 | 0.71 | Example |
| 19 | 0.32 | 0.0037 | 9 | 0.41 | 0.20 | 0.11 | 1.93 | 0.77 | Comparative Example |
| 20 | 0.28 | 0.0036 | 13 | 0.42 | 0.21 | 0.11 | 1.93 | 0.78 | Comparative Example |
| 21 | 0.23 | 0.0035 | 20 | 0.43 | 0.21 | 0.11 | 1.93 | 0.80 | Comparative Example |
| 22 | 0.11 | 0.0035 | 27 | 0.43 | 0.22 | 0.11 | 1.93 | 0.78 | Comparative Example |
| 23 | 0.21 | 0.0030 | 11 | 0.42 | 0.21 | 0.11 | 1.93 | 0.77 | Comparative Example |
| 24 | 0.11 | 0.0026 | 14 | 0.34 | 0.21 | 0.11 | 1.93 | 0.78 | Comparative Example |
| 25 | 0.13 | 0.0036 | 15 | 0.36 | 0.23 | 0.11 | 1.93 | 0.77 | Comparative Example |
| 26 | 0.16 | 0.0043 | 15 | 0.37 | 0.22 | 0.11 | 1.93 | 0.71 | Example |
| 27 | 0.19 | 0.0049 | 11 | 0.38 | 0.23 | 0.11 | 1.93 | 0.70 | Example |
| 28 | 0.23 | 0.0056 | 13 | 0.38 | 0.23 | 0.11 | 1.93 | 0.70 | Example |
| 29 | 0.28 | 0.0045 | 11 | 0.49 | 0.25 | 0.12 | 1.94 | 0.69 | Example |
| 30 | 0.30 | 0.0052 | 10 | 0.52 | 0.26 | 0.12 | 1.94 | 0.68 | Example |
| 31 | 0.33 | 0.0065 | 9 | 0.51 | 0.27 | 0.12 | 1.94 | 0.68 | Example |
| 32 | 0.34 | 0.0074 | 9 | 0.50 | 0.27 | 0.12 | 1.94 | 0.68 | Example |
| 33 | 0.33 | 0.0072 | 10 | 0.53 | 0.27 | 0.12 | 1.94 | 0.69 | Example |
| 34 | 0.34 | 0.0074 | 10 | 0.53 | 0.27 | 0.16 | 1.94 | 0.67 | Example |
| 35 | 0.35 | 0.0075 | 10 | 0.52 | 0.27 | 0.20 | 1.94 | 0.67 | Example |
| 36 | 0.35 | 0.0073 | 10 | 0.52 | 0.27 | 0.27 | 1.94 | 0.67 | Example |

Underlined values are outside of the appropriate range.

As shown in Table 4, every product steel sheet obtained in accordance with the disclosure achieved very low iron loss values.

Example 3

Steel slabs, each having a composition containing C: 0.080%, Si: 3.5%, Mn: 0.08%, S: 0.025%, sol.Al: 0.025%, N: 0.0020%, Sn: 0.040%, and Cu: 0.05%, and the balance being Fe and incidental impurities, were each heated to 1420° C., subjected to hot rolling to obtain hot rolled sheets with a thickness of 2.5 mm. Then, each hot rolled sheet was subjected to hot band annealing at 1020° C. for 30 seconds and subsequent pickling, and then subjected to the first cold rolling to obtain a cold rolled sheet with a thickness of 1.5 mm, and then the cold rolled sheet was subjected to intermediate annealing at 1075° C. for 1 minute, and then to the second cold rolling where the temperature of the steel strip reaches 200° C. to obtain a cold rolled sheet with a thickness of 0.30 mm, which in turn was wound into a coil and subjected to aging treatment at 300° C. for 5 hours and then subjected to the third cold rolling to obtain a final cold rolled sheet with a thickness of 0.23 mm.

Then, decarburization/primary recrystallization annealing which is a combination of decarburization and primary recrystallization, in which the cold rolled sheet is held in a mixed atmosphere of nitrogen, hydrogen, and vapor at 830° C. for 2 minutes was performed, and then nitriding treatment was performed in an atmosphere containing $NH_3$ at 800° C. to set the N content in steel to 0.0100%.

Then, an annealing separator, containing 0.020 parts by mass of Cl, mainly composed of MgO hydrated as shown in Table 5, and having 10 parts by mass of $TiO_2$ added thereto, was applied on the steel sheet so that the coating amount M1 (per steel sheet surface) after application and drying is 7 $g/m^2$, and in turn, the steel sheet was wound into a coil, and then subjected to final annealing where V(400-650) is 12° C./h and V(700-850) is 3° C./h and the steel sheet is held at 1180° C. for 12 hours. Then, insulating tension coating mainly composed of magnesium phosphate, colloidal silica and chromic acid was applied to the steel sheet so that the coating amount M2 (per steel sheet surface) after flattening annealing is 6 $g/m^2$, and in turn, the steel sheet was subjected to continuous annealing in which flattening annealing and baking of insulating tension coating are performed, where the steel sheet is held at maximum temperature $T_{FN}$: 830° C., and mean tension S between ($T_{FN}$—10° C.) and $T_{FN}$: 9 MPa, for 30 seconds under the conditions of table 5.

Then, using each method shown in Table 5, magnetic domain refining treatment was performed under conditions where detachment of the insulating tension coating is not caused by irradiation, with an interval of 6 mm and at an angle of 10° with respect to the direction orthogonal to the rolling direction. Using products obtained as above, SST test pieces were cut out, and measured for their magnetic properties using an SST tester (JISC 2556).

The obtained results are also shown in Table 5. Table 5 also shows FX(Ti)/FX(Al) and FX(Ti)/FX(Fe) obtained through quantitative analysis by applying correction with the ZAF method to results of fluorescent X-ray analysis, and the results of studying the frequency of grain boundaries of secondary recrystallized grains in the TD direction, t(Fo)/t(C), and the surface roughness of the base film.

TABLE 5

| No. | Hydration rate of MgO (mass %) | Magnetic Domain Refining Method | FX(Ti)/FX(Al) | FX(Ti)/FX(Fe) | Frequency of Grain Boundaries of Secondary Recrystallized Grains in TD Direction (Grain Boundaries/100 mm) | t(Fo)/t(C) | Surface Roughness Ra of Base Film (μm) | $B_8$ (T) | $W_{17/50}$ (W/kg) | Remarks |
|---|---|---|---|---|---|---|---|---|---|---|
| 1 | 1 | Plasma Flame | 0.26 | 0.0059 | 9 | 0.39 | 2.3 | 1.93 | 0.67 | Example |
| 2 | 2 | Plasma Flame | 0.26 | 0.0060 | 9 | 0.45 | 2.5 | 1.94 | 0.66 | Example |
| 3 | 3 | Plasma Flame | 0.27 | 0.0064 | 10 | 0.54 | 2.6 | 1.94 | 0.66 | Example |
| 4 | 4 | Plasma Flame | 0.27 | 0.0063 | 10 | 0.64 | 2.8 | 1.94 | 0.66 | Example |
| 5 | 4 | Laser Beam | 0.27 | 0.0063 | 10 | 0.64 | 2.8 | 1.94 | 0.66 | Example |
| 6 | 4 | Electron Beam | 0.27 | 0.0063 | 9 | 0.64 | 2.8 | 1.94 | 0.64 | Example |

As shown in table 5, every product steel sheet obtained in accordance with the disclosure achieved very low iron loss values.

The invention claimed is:

1. A grain-oriented electrical steel sheet before or after subjection to non-heat resistant magnetic domain refining treatment, the grain-oriented electrical steel sheet comprising:

a steel sheet substrate formed by rolling;

a forsterite base film formed on a surface of the steel sheet substrate; and an insulating tension coating formed on the forsterite base film, wherein contents by mass % of Ti, Al, and Fe in the forsterite base film, obtained through quantitative analysis by applying correction with a ZAF method to results of fluorescent X-ray analysis on the surface of the forsterite base film after removing the insulating tension coating are each specified as FX(Ti), FX(Al), and FX(Fe), the following formulas (1) and (2) are satisfied, $$FX(Ti)/FX(Al) \geq 0.15 \quad (1)$$

$$FX(Ti)/FX(Fe) \geq 0.004 \quad (2)$$

a frequency of crystal boundaries of secondary recrystallized grains in the steel sheet substrate in a width direction and orthogonal to a rolling direction of the steel sheet substrate is 20 grain boundaries/100 mm or less, a mean thickness of the forsterite base film is specified as t(Fo), and a thickness of the insulating tension coating is specified as t(C), the following formula (3) is satisfied:

$$t(Fo)/t(C) \geq 0.37 \quad (3),$$

a coating amount M2of the insulating tension coating per steel sheet surface is 4.5 g/m$^2$ or more, and in the ZAF method, "Z" refers to a correction of fluorescent X-ray yield by an atomic number, "A" refers to a correction of X-ray absorption of an observed wavelength by a coexistent element, and "F" refers to secondary excitation correction by a fluorescent X-ray of a coexistent element.

2. The grain-oriented electrical steel sheet according to claim 1, wherein the forsterite base film has an arithmetic mean roughness Ra of a surface facing the insulating tension coating of 0.2 μm or more.

3. The grain-oriented electrical steel sheet according to claim 1, wherein a tension applied by the forsterite base film to the steel sheet substrate per surface is specified as TE(Fo) and a tension applied by the insulating tension coating to the steel substrate per surface is specified as TE(C), the following formula (4) is satisfied:

$$TE(Fo)/TE(C) \geq 0.1 \quad (4).$$

4. The grain-oriented electrical steel sheet according to claim 2, wherein a tension applied by the forsterite base film to the steel sheet substrate per surface is specified as TE(Fo) and a tension applied by the insulating tension coating to the steel substrate per surface is specified as TE(C), the following formula (4) is satisfied:

$$TE(Fo)/TE(C) \geq 0.1 \quad (4).$$

5. The grain-oriented electrical steel sheet according to claim 1, wherein the non-heat resistant magnetic domain refining treatment is performed by electron beam irradiation.

6. The grain-oriented electrical steel sheet according to claim 2, wherein the non-heat resistant magnetic domain refining treatment is performed by electron beam irradiation.

7. The grain-oriented electrical steel sheet according to claim 3, wherein the non-heat resistant magnetic domain refining treatment is performed by electron beam irradiation.

8. The grain-oriented electrical steel sheet according to claim 4, wherein the non-heat resistant magnetic domain refining treatment is performed by electron beam irradiation.

9. A method of manufacturing the grain-oriented electrical steel sheet of claim 1, the method comprising:

subjecting a steel slab to hot rolling to obtain a hot rolled sheet, the steel slab containing by mass %, S and/or Se: 0.005% to 0.040%, sol.Al: 0.005% to 0.06%, and N: 0.002% to 0.020%;

then subjecting the hot rolled sheet to hot band annealing or no hot band annealing;

subjecting the hot rolled sheet to subsequent cold rolling once, or twice or more with intermediate annealing performed therebetween to obtain a cold rolled sheet with final sheet thickness;

then subjecting the cold rolled sheet to primary recrystallization annealing;

then applying an annealing separator to the cold rolled sheet, the annealing separator containing 5 parts by mass or more of $TiO_2$ with respect to 100 parts by mass of MgO being the main component, so that coating amount M1 per steel sheet surface after application and drying is in a range of 6 g/m$^2$ to 12 g/m$^2$;

then subjecting the cold rolled sheet to final annealing;

subjecting the cold rolled sheet to subsequent continuous annealing in which flattening annealing, and application and baking of an insulating tension coating are performed; and then subjecting the cold rolled sheet to non-heat resistant magnetic domain refining treatment or no non-heat resistant magnetic domain refining treatment, wherein in a heating process of the final annealing, a heating rate V(400-650) between 400° C. and 650° C. is 8° C./h or higher, and a ratio V(400-650)/V(700-850) of theheating rate V(400-650) to a heating rate V(700-850) between 700° C. and 850° C. is 3.0 or more, and in the flattening annealing, coating amount M2 in g/m$^2$ of an insulating tension coating mainly composed of colloidal silica and phosphate per steel sheet surface after application and baking satisfies the following formula (5):

$$4.5 \leq M2 \leq M1 \times 1.2 \quad (5).$$

10. The method of manufacturing a grain-oriented electrical steel sheet according to claim 9, wherein the annealing separator contains 0.005 parts by mass to 0.1 parts by mass of Cl with respect to 100 parts by mass of MgO.

11. The method of manufacturing a grain-oriented electrical steel sheet according to claim 9, wherein a maximum temperature $T_{FN}$ in ° C. in the flattening annealing is 780° C. to 850° C., mean tension S between ($T_{FN}$−10° C.) and $T_{FN}$ is 5 MPa to 11 MPa, and $T_{FN}$ and the mean tension S satisfy the following formula (6):

$$6500 \leq T_{FN} \times S \leq 9000 \quad (6).$$

12. The method of manufacturing a grain-oriented electrical steel sheet according to claim 10, wherein a maximum temperature $T_{FN}$ in ° C. in the flattening annealing is 780° C. to 850° C., mean tension S between ($T_{FN}$−10° C.) and $T_{FN}$ is 5 MPa to 11 MPa, and $T_{FN}$ and the mean tension S satisfy the following formula (6):

$$6500 \leq T_{FN} \times S \leq 9000 \quad (6).$$

13. The method of manufacturing a grain-oriented electrical steel sheet according to claim 9, wherein the non-heat resistant magnetic domain refining treatment is performed by electron beam irradiation.

14. The method of manufacturing a grain-oriented electrical steel sheet according to claim 10, wherein the non-heat resistant magnetic domain refining treatment is performed by electron beam irradiation.

15. The method of manufacturing a grain-oriented electrical steel sheet according to claim 11, wherein the non-heat resistant magnetic domain refining treatment is performed by electron beam irradiation.

16. The method of manufacturing a grain-oriented electrical steel sheet according to claim 12, wherein the non-heat resistant magnetic domain refining treatment is performed by electron beam irradiation.

* * * * *